United States Patent [19]

MacDonald

[11] Patent Number: 4,485,754

[45] Date of Patent: Dec. 4, 1984

[54] AUTOMATIC LOADER FOR SEWING MACHINES

[75] Inventor: Kenneth A. MacDonald, Canton, Mass.

[73] Assignee: Compo Industries, Inc., Waltham, Mass.

[21] Appl. No.: 431,761

[22] Filed: Sep. 30, 1982

[51] Int. Cl.[3] ..... D05B 21/00

[52] U.S. Cl. ..... 112/262.3; 112/121.12; 112/121.15

[58] Field of Search ..... 112/121.15, 121.11, 112/121.12, 121.29, 2, 262.3, 262.1

[56] References Cited

U.S. PATENT DOCUMENTS

| | | | |
|---|---|---|---|
| 3,034,458 | 5/1962 | Bennison | 112/121.12 X |
| 3,769,924 | 11/1973 | Rogers et al. | 112/121.12 X |
| 3,814,038 | 6/1974 | Dorosz et al. | 112/121.15 |
| 3,977,337 | 8/1976 | Yanikoski | 112/121.12 |
| 4,031,835 | 6/1977 | Gilbride et al. | 112/121.12 X |
| 4,171,672 | 10/1979 | Dorosz et al. | 112/121.12 |

*Primary Examiner*—H. Hampton Hunter

*Attorney, Agent, or Firm*—Robert T. Gammons

[57] ABSTRACT

A system for loading a workpiece onto a carriage for traverse relative to a pattern-producing instrumentality comprising a bottom plate positioned on the carriage, a top plate, a picker movable relative to the carriage from a loading position remote from the carriage to a clamping position adjacent the carriage, electromagnets on the picker for releasably holding the top plate thereon for movement therewith on the one hand to lift the top plate from the bottom plate to said loading position and on the other hand to lower the top plate to said clamping position, positioning pins on the picker for positioning and holding the workpiece on the top plate in a predetermined position thereon during movement of the top plate from the loading position to and from the clamping position, said electromagnet being operative to release the top plate at the clamping position, holes in the top plate and pins on the bottom plate interengageable when the top and bottom plates are brought into engagement at the clamping position to align the plates and means at the clamping position for clamping the plates to each other with the workpiece therebetween.

36 Claims, 6 Drawing Figures

AUTOMATIC LOADER FOR SEWING MACHINES

BACKGROUND OF THE INVENTION

Conventionally, automatic sewing machines are provided with work holders which are removably attached to the carriage by means of which the workpiece is moved relative to a sewing needle for sewing a predetermined pattern thereon. The carriage has an initial loading position to one side of the sewing needle to enable placing the workpiece to be operated on in the work holder. Generally, the work holders are comprised of two metal plates between which the workpiece must be positioned, hence, the operator not only has to remove and replace a work holder for each cycle of operation, but also to clamp and unclamp the plates, which is time-consuming. Moreover, the work holders are heavy and, hence, difficult to handle, are relatively expensive to manufacture, and two are required for each machine. It is the purpose of this invention to provide a work holder and system of use which will enable eliminating the need for one operator to remove the work holder from the carriage, to provide a system wherein the operator has only to handle the workpiece itself which is very light in weight in comparison to the work holder, to provide a system which is automated to the extent that the work holder is alternately moved between a loading position for receiving a workpiece and a clamping position for clamping a workpiece to the carriage for traversing relative to the needle and to provide a work holder which is relatively inexpensive and readily adaptable to a variety of kinds of operations which may include, in addition to sewing operations, cutting, punching, embossing and printing, operations for constructional and/or decorative purposes.

SUMMARY OF INVENTION

As herein illustrated, the invention resides in a device for positioning and clamping a workpiece or pieces to a carriage for movement relative to a pattern-forming instrumentality comprising a bottom plate positioned on the carriage, said bottom plate containing an opening, a top plate containing an opening, means on the top and bottom plates interengageable when the plates are brought into engagement to align the openings therein, said top plate containing, in addition, two or more apertures located thereon within the area defined by the workpiece or pieces to be operated upon and latches at the opposite ends of the bottom plate arranged to clamp the top plate to the bottom plate with the openings therein aligned and with the workpiece therebetween. The device includes a picker movable relative to the frame from a loading position above the carriage to the clamping position, first means on the picker for releasably holding the top plate thereon for movement therewith on the one hand to lift the top plate from the bottom plate to the loading position and on the other hand to lower the top plate into the clamping position of engagement with the bottom plate on the carriage and release it and second means on the picker for positioning and holding the workpiece or pieces in alignment with the openings in the top and bottom plates. Desirably, but not necessarily, the first means are electromagnets and the second means are positioning pins for aligning the workpiece or pieces with the openings and suction cups for holding the workpiece or pieces to the top plate. There is means for effecting movement of the picker rectilinearly relative to the carriage and for rotation about a horizontal axis parallel to the picker. Two top plates are employed, one at each broad side of the picker which are alternately usable by rotation of the picker to present first one top plate and then the other top plate facing upwardly at the loading position for placing a workpiece thereon and downwardly for movement into engagement with the bottom plate.

The openings in the top and bottom plates correspond generally in configuration to the configuration of the pattern to be made and there are additional openings in the top plate for receiving the suction cups on the picker located within an area defined by the workpiece placed on the top plate to hold the latter to the top plate and means for moving the picker with a workpiece held thereto at the downwardly-facing side by the vacuum cups downwardly from the loading position to engage the top plate with the bottom plate so as to sandwich the work therebetween, clamping the top plate to the bottom plate, releasing the workpiece and top plate from the picker, moving the carriage from the clamping position to the pattern-forming instrumentality for formation of a pattern on the workpiece, while the carriage is in the pattern-forming position, moving the picker back up to the loading position, at which position a previously-formed workpiece is removed and a workpiece to be operated upon is placed on the upwardly-facing side of the picker, moving the picker down from the loading position to a position just above the clamping position in readiness to pick a finished workpiece from the carriage when the latter returns to the clamping position, lowering the picker the remainder of the way down into engagement with the carriage when the latter returns to the clamping position, reattaching the workpiece and top plate to the picker, releasing the latches, raising the picker to the loading position, rotating the picker lowering the picker and placing the new workpiece as before, raising the picker to present the finished workpiece to the upwardly-facing side and, at that position, stripping the finished workpiece from the picker and replacing it with the next workpiece to be operated upon, whereupon the cycle is re-initiated.

Optionally, there may be a work holder in the form of a magazine for holding a stack of workpieces from the bottom of which the picker can pick workpieces one at a time and means for alternately moving the magazine from a retracted position to the loading position of the picker.

The method of loading a workpiece onto a supporting carriage for traverse relative to a pattern-forming instrumentality comprising, with the aid of a bottom plate mounted on the carriage, a top plate and a picker to which the top plate can be alternatively attached and detached and which is movable relative to the carriage from a loading position to a position such as to engage the top plate with the bottom plate, moving the picker from a loading position with a top plate and workpiece held thereto downwardly to a position of engagement of the top plate with the bottom plate for clamping the workpiece therebetween, clamping the top plate to the bottom plate, releasing the top plate and workpiece from the picker, moving the carriage from the clamping position to the pattern-forming instrumentality and while the pattern-forming instrumentality is in operation, raising the picker to the loading position, removing a finished workpiece therefrom and replacing it with the next piece to be operated on, lowering the picker to a position just above the clamping position of the carriage and when the pattern-forming operation is completed, returning the carriage to the clamping position, lowering the picker the remainder of the way into engagement with the top plate and finished workpiece, reattaching the workpiece and top plate to the picker, releasing the top plate from the bottom plate, raising the picker to the loading position, rotating the picker, lowering the picker and placing the new workpiece as before, raising the picker to present the finished workpiece to the upwardly-facing side, stripping the finished workpiece from the picker and replacing it with the next workpiece to be operated upon and reinitiating the cycle of operation.

BRIEF DESCRIPTION OF THE DRAWINGS

The invention will now be described in greater detail with reference to the accompanying drawings, wherein:

Referring to the drawings, FIG. 1 shows a part 4, for example, the vamp portion of a shoe, to which there is attached an applique 6 of like or different material by means of stitching 8. The operation of attaching the applique to the vamp is generally carried out on an automatic sewing machine by mounting the two pieces to be attached, to wit, the pieces 4 and 6 in a work holder which, in turn, is mounted on a carriage by means of which it is traversed relative to a sewing machine needle to form the stitching 8 thereon according to a predetermined pattern. The work holder for holding the parts in position on the carriage for sewing is comprised of sheet metal parts hinged to each other for clamping engagement with the work placed between them, requires that the operator secure the hinged parts to each other after placing the workpiece therebetween with fastening means, is heavy, inexpensive to manufacture and two such clamps are required for each sewing machine to enable the operator to load one work holder while the other is being traversed relative to the needle of the sewing machine.

Figures 1, 2:
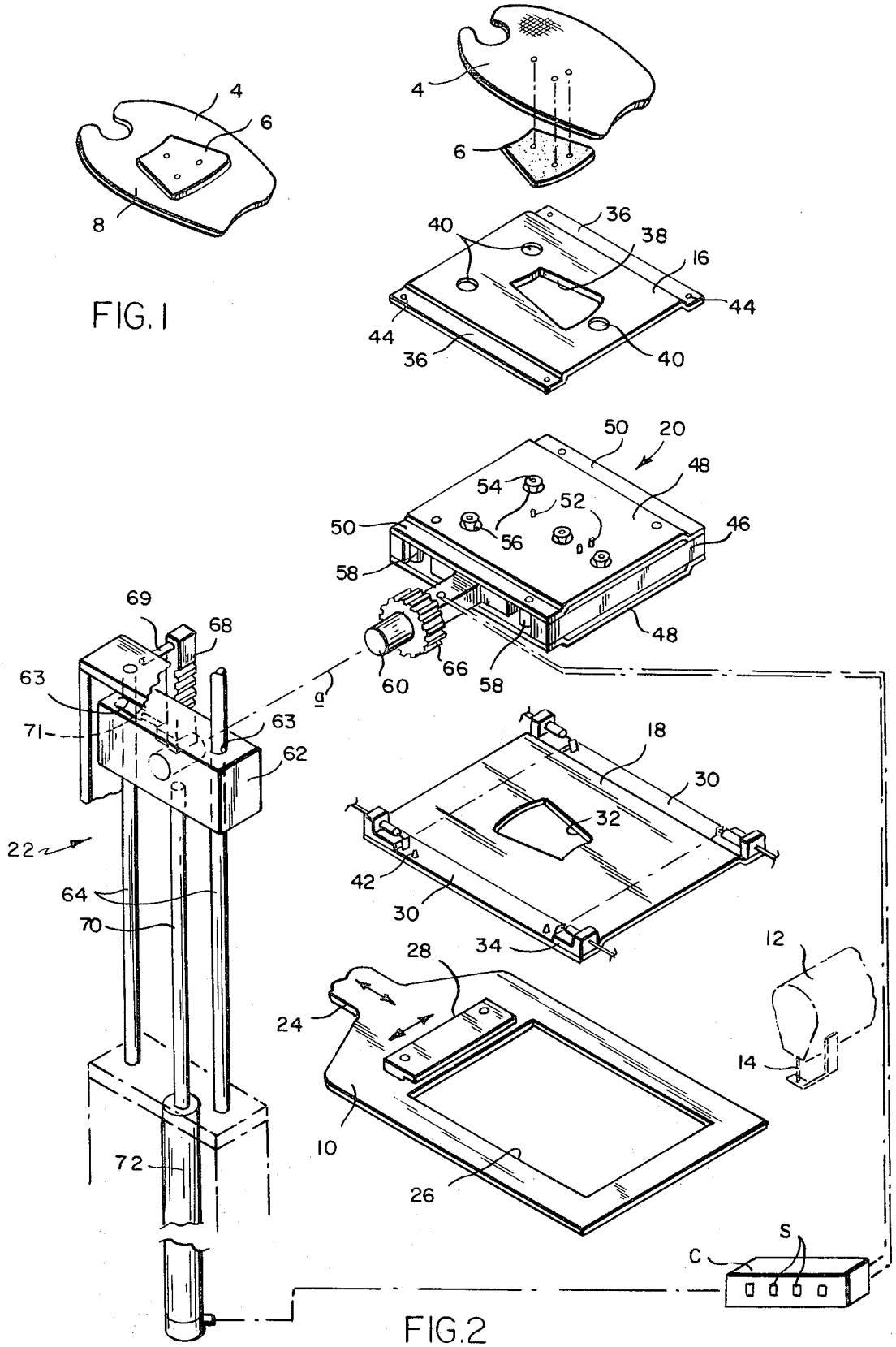
FIG. 1 is a plan view of a part of an upper of a shoe to which an applique is attached by stitching.
FIG. 2 is an explosed perspective of a work holder for receiving a workpiece at a loading station and clamping it.
Figure 3:
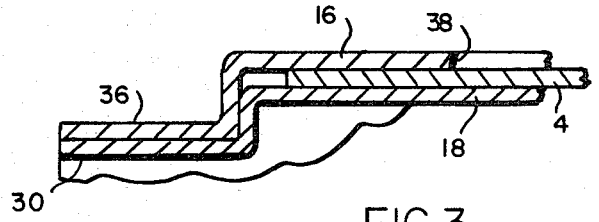
FIG. 3 is an enlarged fragmentary section of the top and bottom plates of the work holder with a workpiece sandwiched therebetween.

It is the purpose of this invention to improve upon the aforesaid apparatus to the extent that the operator will have only to handle the workpiece itself. This is achieved herein with the equipment illustrated in FIG. 2 which comprises a traversing carriage or frame 10 movable relative to a sewing head 12 provided with a needle 14, a top plate 16, a bottom plate 18, a picker 20 and means 22 supporting the picker 20 for rotation about a horizontal axis and for rectilinear movement perpendicularly with respect to the plane of the traversing carriage 10.

The traversing carriage 10 as shown is of generally rectangular configuration, is provided at one end with a part 24 which connects it to traverse mechanism controlled by patterning means to move it relative to the sewing head according to the desired pattern, contains an opening 26 for receiving the bottom plate 18 and is provided with a clamp plate 28 by means of which the bottom plate 18 can be clamped to it within the opening 26.

The bottom plate 18 is comprised of sheet metal, plastic or some such material, has along its opposite, parallel, longitudinal sides stiffening flanges 30-30 which are offset downwardly with respect to the plane of the plate and intermediate its side and end edges a generally centrally-located opening 32. The opening 32 is of the configuration of the applique to be attached to the vamp. At the four corners of the bottom plate 18, there are latch members 34 actuatable by suitable means to be engaged with or disengaged from the top plate 16 when the latter is positioned on the bottom plate. The latch members 34 may be operated mechanically, electrically or pneumatically.

The top plate 16 is also made of sheet metal and has along its opposite longitudinal edges stiffening flanges 36-36 which are offset downwardly. Centrally of the top plate 16, there is an opening 38 corresponding to the opening 32 in the bottom plate and laterally thereof within an area defined by the area of the workpiece to which the applique is to be attached, two or more apertures 40.

There are locating pins 42 fixed to the flanges 30-30 of the bottom plate 18 and openings 44-44 in the flanges of the top plate 16 interengageable when the plates are moved into engagement as will appear hereinafter to so orient the top and bottom plates that the openings 32 and 38 will be in perfect alignment.

The picker 20 comprises a shallow box-like frame 46 and is provided on its opposite broad faces with panel members 48-48. Each panel member 48-48 has along its opposite sides flanges 50-50 offset from the plane of the panel so as to mate with a top plate 16. The panel members 48-48 are secured to the frame 46 and each has on it a plurality of positioning pins 52 and a plurality of suction cups 54. The positioning pins 52 are fixed to the upper side of the panel members and the suction devices 54 extend from within the frame 46 through apertures 56 in the panel members. The positioning pins 52 are located to extend upwardly through the opening 38 in the top plate 16 when the latter is placed on the picker for engagement with the workpieces to be joined to hold the workpieces in the proper position for the sewing operation. The suction cups 54 are positioned to have contact with the work laterally of the applique to hold the assembly to the face of the top plate 16.

Internally of the frame 46 at the corners, there are electromagnets 58 which, energized, will hold a top plate 16 to either or both sides of the picker and which, when de-energized, will release the top plate or plates from the picker.

The picker 20 is mounted by means of a shaft 60 journaled in a bearing block 62 for rotation about the horizontal axis a and for rectilinear vertical movement relative to the plane of the carriage 10, the latter movement being provided for by spaced, parallel, vertically-supported rods 64-64 upon which the block 62 is mounted by means of transversely-spaced holes 63-63 within which the rods are received. The block 62 is reciprocated vertically which, in turn, reciprocates the picker vertically by a rod 70 connected at its upper end to the block and at its lower end to a piston and cylinder assembly 72. In order to provide for rotational movement, a pinion 66 is fixed to the shaft 60 and a rack 68 is supported for engagement with the pinion. The rack is pivotally supported by a pin 69 and there is means 71 for alternately moving the rack into and out of engagement with the pinion. The rack and pinion provide for rotating the picker alternately in clockwise and counterclockwise directions through 180° and the piston and cylinder assembly 72 provide for reciprocating the picker vertically.

According to the invention, the picker 20 has opposed panel members 48 which are alternately movable by rotation of the picker from an upwardly-facing position for loading of the parts to be operated on to a downwardly-facing position followed by downward movement of the picker to engage the top plate 16 with the bottom plate 18.

In operation, assuming that a workpiece or workpieces is held properly positioned by the positioning pins 52 to the top plate 16 at the downwardly-facing side of the picker 20 by the vacuum cups 54, the picker moves down to a position to press the workpieces and top plate 16 against the bottom plate 18 on the carriage at the loading position thereof with sufficient pressure to ensure clearing the latches 34, whereupon the latches are actuated to engage and clamp the top plate 16 to the bottom plate 18 with the workpiece clamped therebetween. Now the vacuum is released, the magnets are de-energized and the picker 20 moves upwardly, leaving the carriage free to transport the clamping plates with the workpiece therebetween to the pattern-forming instrumentality. When the picker 20 reaches the top position, the operator removes the previously stitched workpiece from the upwardly-facing side of the picker or, if there is not a finished workpiece on the upwardly-facing side, places the next workpiece to be operated on upon the upwardly-facing side of the picker, whereupon the picker descends to a position just above the plane of the clamping position of the carriage in readiness for receiving a finished workpiece. The upward and downward movement of the picker insures that the picker will be in a position to receive the finished workpiece when the carriage returns from the pattern-forming position without loss of time. At the moment that the carriage returns to the clamping position, the picker descends the remainder of the way into engagement with the finished workpiece and the top plate, whereupon the vaccum is reapplied to hold the workpiece to the top plate, the magnets are re-energized to hold the top plates to the picker and the latches are released to, in turn, release the top plate from the bottom plate. Now the picker rises to the loading position and rotates about the horizontal axis of the shaft 60 to position the previously-mounted workpiece to be operated on at the underside and the finished workpiece at the top side, whereupon the picker is lowered to place the new workpiece as before, the picker returns to the top where the operator strips the finished workpiece from the top side and replaces it with the next piece to be sewn and the picker commences its next cycle of operation.

Figure 6:
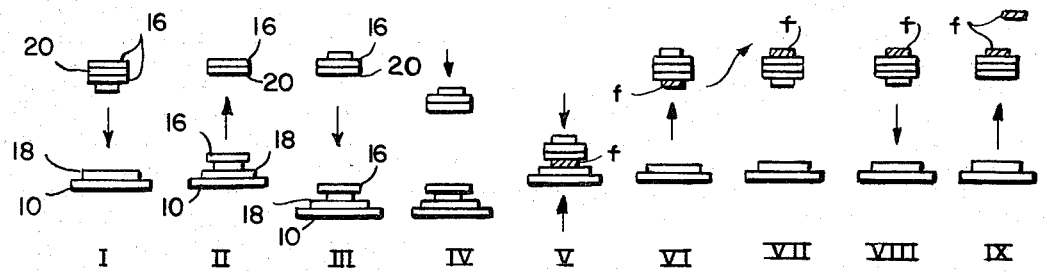
FIG. 6 diagrammatically illustrates the sequence of operations.

Referring to FIG. 6 which diagrammatically illustrates the sequence of operations, at position I, the picker 20 is shown with a top plate 16 at the top and bottom sides and with a workpiece at the bottom side in readiness for commencing a cycle of operation. At position II, the picker 20 has deposited the top plate 16 and workpiece in the bottom plate 18 for clamping thereto and has returned to the loading position. Position III shows the carriage 10, together with the top and bottom plates and a workpiece sandwiched therebetween, moved away for the pattern-forming operation and the picker 20 at the loading position where a workpiece to be operated on is placed upon the top plate 16 at the upwardly-facing side of the picker. At position IV, the carriage with the top and bottom plates and the workpiece is still in the pattern-forming position. The picker 20 with the top plate 16 and the new workpiece thereon has moved downwardly to a position between the loading position and the clamping position. At position V, the carriage has returned to the clamping position with the finished workpiece thereon and the picker 20 has moved down the remainder of the distance into engagement with the finished workpiece. At position V, the top plate and workpiece have been reattached to the picker and the clamps released. At position VI, the picker has moved to the loading position with the top plate 16 and finished workpiece at the underside and the top plate and workpiece to be sewn at the top side. At position VII, the picker has rotated so that now the top plate 16 and the finished workpiece are at the upper side and the top plate and the workpiece to be operated on is at the underside. At position VIII, the picker is lowered to place the new workpiece on the conveyor, whereupon the picker is raised to position IX to position the finished workpiece at the top, the finished workpiece is stripped from the top plate at the upwardly-facing side of the picker and a workpiece to be operated upon is placed upon the top plate at the upper side of the picker, whereupon the next cycle of operation is commenced.

As related above, the picker is rotated 180° first in one direction and then the other. This is to enable using flexible wiring and tubing for the electromagnets and the vacuum heads without twisting of the wires and/or tubing about the shaft 60.

Figure 4:
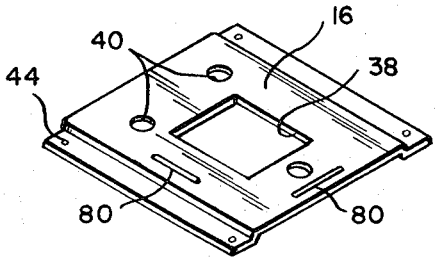
FIG. 4 is a plan view of a top plate provided with work positioning means on its surface in lieu of the work-positioning pins on the picker.

As also described above, the positioning pins 52 are fixed to the picker. However, it is within the scope of the invention to provide positioning means in the form of shallow ridges 80 or lines on the surface of the top plates 16 for properly locating the workpiece thereon as shown, for example, in FIG. 4.

Heretofore, most work clamps have been comprised of relatively thin sheet metal parts between which the workpiece is positioned and, because of their flexibility, the position of the workpiece between them distorted these parts to a certain extent which, in turn, distorted the pattern to be applied. An important feature of the structure herein illustrated resides in the fact that the top and bottom plates 16 and 18 are comprised of steel and are provided with stiffening flanges 30-30, 36-36 at their opposite edges to prevent distortion and thus to preserve accuracy. The weight factor is not a consideration herein as it is in conventional apparatus in that the operator never has to handle the clamping plates 16 and 18, but only the workpiece which is placed on and removed from the top plate 16 when the picker is in its uppermost loading position. The only time that the top and bottom plates would be handled would be when a completely different operation was to be performed and the apparatus would have to be provided with different top and bottom plates.

Figure 5:
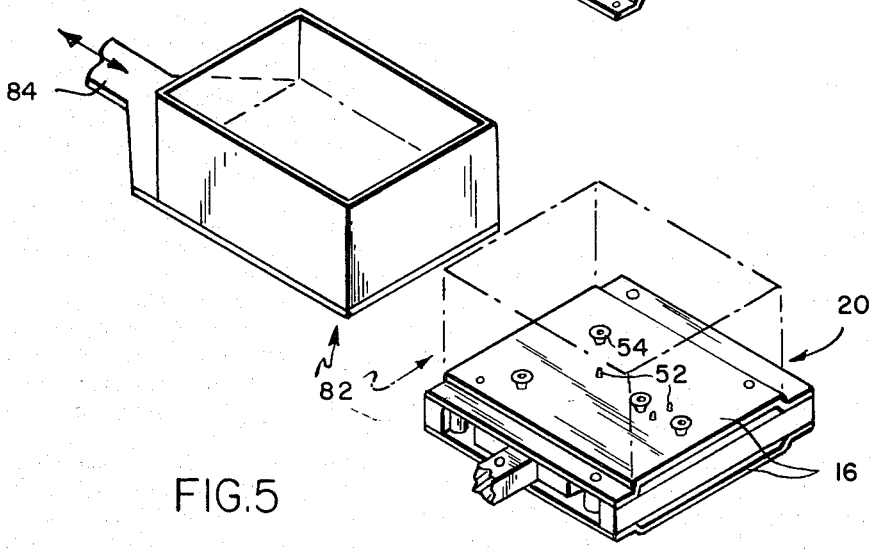
FIG. 5 diagrammatically illustrates a magazine for holding workpieces movable from a retracted position to the loading position of the picker.

The system described above requires that the operator remove a finished workpiece from the top plate at the loading position and replace it with the next piece to be sewn. In order that an operator can tend two machines, a magazine 82 may be employed for dispensing workpieces directly to the picker at the picking position as shown in FIG. 5. Such a magazine 82 can be mounted for horizontal movement from the retracted position to a position just above the picker at the loading position for removal of the lowermost workpiece through a bottom opening by means of the suction cups on the picker. A piston and cylinder assembly 84 may be employed to effect reciprocal movement of the magazine and, when a magazine is employed, the latter will be moved into a position above the picker at its loading position when the picker is raised from the clamping position to the loading position and rotated to position the finished workpiece facing upwardly.

A control module is shown at C, FIG. 2, which may be provided with manual switches to enable the operator to control the sequence of operation or with a memory unit for automatically sequencing the operation in accordance with well-known circuitry.

The apparatus has been described herein as providing for joining two parts of a shoe by means of stitching. The apparatus may be used in the same fashion for applying a pattern of stitching to a signal part. Further, the supporting structure described can be used in combination with other instrumentalities for producing patterns in the form of holes, perforations, indentations, embossments, weldments and prints both for constructional purposed and/or for decorating purposes.

It should be understood that the present disclosure is for the purpose of illustration only and includes all modifications or improvements which fall within the scope of the appended claims.

What is claimed is:

1. A system for loading a workpiece onto a carriage for traverse relative to a pattern-producing instrumentality comprising a bottom plate positioned on the carriage, said base plate containing an opening, a top plate containing a corresponding opening, a picker movable relative to the carriage from a loading position remote from the carriage to a clamping position adjacent the carriage, first means on the picker for releasably holding the top plate thereon for movement therewith on the one hand to lift the top plate from the bottom plate to said loading position and on the other hand to lower the top plate to said clamping position, second means on the picker for positioning and holding the workpiece on the top plate in alignment with the opening during movement of the top plate from the loading position to and from the clamping position, said first means being operative to release the top plate at the clamping position, means on the top and bottom plates interengageable when the top and bottom plates are brought into engagement at the clamping position to align the openings therein and means at the clamping position for clamping the plates to each other with the workpiece therebetween.

2. A system according to claim 1 wherein the first means comprises electromagnets.

3. A system according to claim 1 wherein the second means comprise suction cups and positioning pins.

4. A system according to claim 1 wherein the picker is rotatable about an axis parallel to the plane of the carriage and the first means is operable to hold two top plates on the picker in spaced, parallel relation to each other at diametrically-opposed sides of the axis of rotation thereof such that when one top plate is facing the carriage, the other top plate is facing away from the carriage.

5. A system according to claim 4 wherein the top plates have stiffening flanges along two parallel sides and the picker has two recesses along two corresponding side for receiving said stiffening flanges.

6. A system according to claim 4 wherein the top plates contain two or more apertures located laterally of the opening therein and the suction cups are located within said apertures.

7. A system according to claim 3 wherein the positioning pins are located within the openings in the top plates.

8. A system according to claim 5 wherein the means on the top and bottom plates for aligning them comprise pins fixed to the flanges of one of the plates and holes in the flanges of the other of the plates.

9. A system according to claim 1 comprising a shaft supporting the picker for rotation about an axis parallel to the carriage and a bearing block mounting the shaft for rectilinear movement toward and away from the carriage.

10. A system according to claim 9 comprising means for rotating the shaft and means for reciprocating the bearing block.

11. A system according to claim 10 wherein the means for rotating the shaft provides for rotating the picker alternately 180° in one direction and then 180° in the opposite direction.

12. A system according to claim 3 wherein the positioning pins are located on the picker in a position to be within the opening in the top plate.

13. A system according to claim 3 wherein there are apertures in the top plate positioned laterally of the opening therein and the suction cups are located on the picker within said apertures.

14. A system according to claim 1 wherein there is means on the carriage for removably clamping the bottom plate thereto.

15. A system according to claim 1 wherein the means for clamping the plates to each other are latches mounted to the bottom plate.

16. A system according to claim 10 wherein the means for effecting rotation of the picker comprise a rack and pinion and means for effecting reciprocation of the rack is a piston cylinder.

17. A system according to claim 2 wherein the picker comprises a rectangular frame having spaced, parallel broad sides located at diametrically-opposed sides of the axis of rotation of an area to receive the top plates and the electromagnets are located between the broad sides.

18. A system according to claim 4 wherein there is control means operable to rotate the picker at its elevated position to position the picker alternately with one side facing upwardly and the other side facing downwardly and means for moving the picker rectilinearly relative to the carriage to on the one hand position the top plate in engagement with the bottom plate, release the top plate and lock the top plate to the bottom plate and on the other hand to release the top plate from the bottom plate and return the picker to its elevated position.

19. A picker according to claim 1 wherein the first and second means are magnets and suction cups and wherein there are flexible conductors connected to the electromagnets and suction cups arranged to provide power to the electromagnet and to the suction cups without impairment from the rotation of the picker.

20. Apparatus for clamping a workpiece to a carriage for traverse of the workpiece relative to a pattern-forming instrumentality comprising a bottom clamp plate on the carriage, a picker including a top clamp plate movable from a loading position remote from the carriage to a position to deposit the workpiece and top plate on the bottom clamp plate, a magazine movable to and from the loading position of the picker from which the picker can, when the magazine is at the loading position, pick a workpiece from the magazine, means for moving the picker from the loading position to the place of deposit to deposit the top clamp plate and workpiece on the bottom clamp plate, means for clamping the top clamp plate to the bottom clamp plate with the workpiece therebetween, means for releasing the top clamp plate and workpiece, said means for clamping the top clamp plate to the bottom clamp plate operating following the pattern-forming operation to release the top clamp plate from the bottom clamp plate and said picker being operable at the release of the top clamp plate to pick the top clamp plate and workpiece from the bottom clamp plate and return it to the loading position, whereupon the finished workpiece can be stripped from the picker.

21. Apparatus according to claim 20 wherein the picker is rotatable about an axis at the loading position such as to present the top clamp plate holding a finished workpiece in a position facing the magazine for stripping the finished workpiece therefrom and preparatory to picking a workpiece from the magazine.

22. Apparatus according to claim 20 wherein the picker is rotatable about an axis at the loading position and has two top plates thereon at diametrically-opposite sides of the axis of rotation such that one of the top plates faces the magazine when the latter is at the loading position and the other faces the bottom clamp plate.

23. Apparatus according to claim 21 comprising means for holding the magazine in a position retracted from the loading position as the picker returns to said loading position following a pattern-forming operation until the finished workpiece can be stripped from the picker.

24. Apparatus according to claim 22 comprising means for moving the magazine to the work position as the picker returns to said position to permit the picker to pick a workpiece from the magazine and thereafter to return the magazine to said retracted position.

25. A device for supporting and clamping a workpiece during formation of a pattern thereon by means of a pattern-forming instrumentality comprising a bottom plate containing an opening, a top plate containing a corresponding opening, said openings being of a predetermined configuration such as to receive the pattern-forming instrumentality when superimposed with a workpiece therebetween, means on the top and bottom plates interengageable when the plates are brought into engagement to align the openings therein and interengageable means on the plates for releasably locking the plates to each other with the workpiece sandwiched therebetween.

26. A device according to claim 25 wherein the means for aligning the plates comprise positioning pins on one of the plates and apertures on the other plate for receiving the positioning pins.

27. A device according to claim 25 wherein there are stiffening flanges along two longitudinal edges of the top and bottom plates.

28. A device according to claim 27 wherein the means for aligning the plates comprise pins fixed to the flanges of one of the plates and apertures in the flanges of the other of the plates.

29. A device according to claim 27 wherein the means for locking the plates to each other are latches fixed to one of the plates engageable with the other of the plates.

30. The method of loading a workpiece onto a supporting carriage for traverse relative to a pattern-forming instrumentality comprising with the aid of a bottom plate mounted on the carriage, a top plate for clamping the workpiece to the bottom plate and a picker to which the top plate can be alternately held and released, moving the picker and the top plate therewith relative to the carriage to engage a workpiece held to the top plate with the bottom plate for clamping thereto, releasing the top plate and workpiece from the picker, clamping the top plate to the bottom plate with the workpiece therebetween for traversing with the carriage relative to the pattern-forming instrumentality to form the pattern on the workpiece and when the pattern has been formed and the carriage returned from the pattern-forming instrumentality, engaging the top plate and workpiece with the picker, releasing the top plate from the bottom plate, returning the picker to its loading position and stripping the workpiece from the top plate.

31. The method of loading a workpiece onto a supporting carriage for traverse relative to a pattern-forming instrumentality comprising, with the aid of a bottom plate mounted on the carriage, a picker and top plate and wherein the picker is rotatable about an axis parallel to the plane of the carriage to move the top plate from a position facing away from the carriage to a position facing the carriage and is further movable rectilinearly toward and from the carriage, moving the picker from the loading position with the top plate and workpiece held to the side of the picker facing the carriage to a position to engage the top plate and workpiece with the bottom plate, clamping the top plate to the bottom plate with the workpiece therebetween for traverse with the carriage relative to the pattern-forming instrumentality, releasing the top plate and workpiece from the picker for movement with the carriage and when the pattern is formed, retracting the carriage, reattaching the top plate and workpiece to the picker, releasing the top plate from the bottom plate, returning the picker to its initial loading position, rotating the picker to a position facing away from the carriage and stripping the finished workpiece from the top plate.

32. A method according claim 31 comprising replacing the finished workpiece with a workpiece to be operated on and repeating the cycle of operation.

33. The method of loading a workpiece onto a supporting carriage for traverse relative to a pattern-forming instrumentality comprising, with the aid of a bottom plate mounted on the carriage, two top plates and a picker to which the top plates can be alternately secured and released and wherein the picker is rotatable to alternately position one of the top plates in a position facing the bottom plate and the other facing away from the bottom plate and vice versa and wherein the picker is reciprocal rectilinearly relative to the bottom plate, moving the picker from the loading position with the top plate and workpiece held to the side of the picker facing the carriage to a position to engage the top plate and workpiece with the bottom plate, clamping the top plate to the bottom plate with the workpiece sandwiched therebetween, releasing the top plate and workpiece from the picker, moving the carriage with the top plate and workpiece to a position for the pattern-forming operation, returning the carriage from the pattern-forming instrumentality following completion of the pattern, re-engaging the top plate and workpiece with the picker, releasing the top plate from the bottom plate, returning the picker to the loading position, rotating the picker to position the finished workpiece at the upwardly-facing side, lowering the picker, placing the new workpiece as before, returning to the top position, stripping the finished workpiece from the picker, replacing it with the next workpiece to be operated upon and then repeating the cycle of operation.

34. The method according to claim 33 comprising rotating the picker at the loading position from a position in which first one top plate and then the other top plate faces upwardly.

35. The method of loading a workpiece onto a supporting carriage for traverse relative to a pattern-forming instrumentality comprising, with the aid of a bottom plate mounted on the carriage, two top plates and a picker to which the top plates can be alternately secured and released and wherein the picker is rotatable to alternately position one of the top plates in a position facing the bottom plate and the other facing away from the bottom plate and vice versa and wherein the picker is reciprocal rectilinearly relative to the bottom plate, moving the picker from said loading position with a workpiece held to the top plate at the downwardly-facing side down to engage the top plate and workpiece with the bottom plate, clamping the top plate to the bottom plate, releasing the top plate and workpiece from the picker, moving the carriage to the pattern-forming position and while operating on the workpiece at said pattern-forming position, raising the picker to the loading position and, in the loading position, placing a workpiece on the upwardly-facing top plate, lowering the picker from the loading position to a position above the clamping position of the carriage and when the carriage returns from said pattern-forming position, moving the picker the remainder of the way down to engage the picker with the workpiece and top plate on the carriage, reattaching the workpiece and top plate to the picker, releasing the top plate from the bottom plate, raising the picker to the loading position, rotating the picker to present the finished workpiece at the upwardly-facing side, stripping the finished workpiece from the picker and replacing it with the next workpiece to be operated on.

36. The method of loading workpieces onto a supporting carriage for traverse relative to a pattern-forming instrumentality comprising with the aid of a bottom plate mounted on the carriage, two top plates and a picker to which the top plates may be alternately secured and released, and wherein the picker is rotatable to alternately position one of the top plates in a position facing the bottom plate and the other facing away from the bottom plate and vice versa and wherein the picker is reciprocal rectilinearly relative to the bottom plate, moving the picker with a top plate and workpiece held to the downwardly-facing side thereof from the loading position downwardly into engagement with the bottom plate on the carriage, clamping the top plate to the bottom plate, releasing the top plate and workpiece from the picker, raising the picker from the clamping position to the loading position and moving the carriage with the top and bottom plates with the workpiece sandwiched thereto to a position for the pattern-forming operation, placing a workpiece on the top plate at the upwardly-facing side of the picker at the loading position of the picker, moving the picker with the top plate and workpiece downwardly from the loading position partway to the clamping position while the pattern-forming operation continues to take place, when the pattern-forming operation is completed, returning the carriage to the clamping position and moving the picker down into engagement with the top plate and finished workpiece, reattaching the top plate and finished workpiece to the picker and releasing the clamp, raising the picker with the top plate and finished workpiece at its underside to the loading position, rotating the picker to present the top plate and finished workpiece at the upwardly-facing side and stripping the finished workpiece from the top plate, replacing it with a workpiece to be operated on and recommencing the cycle of operation.

* * * * *